US005145339A

United States Patent [19]

Lehrke et al.

[11] Patent Number: 5,145,339

[45] Date of Patent: Sep. 8, 1992

[54] PULSELESS PISTON PUMP

[75] Inventors: Kenneth E. Lehrke, Maple Grove; Bruce A. McFadden, Orono, both of Minn.

[73] Assignee: Graco Inc., Minneapolis, Minn.

[21] Appl. No.: 610,841

[22] Filed: Nov. 8, 1990

Related U.S. Application Data

[63] Continuation-in-part of Ser. No. 391,097, Aug. 8, 1989.

[51] Int. Cl.[5] ..... F04B 21/00; F04B 23/04; F04B 39/10; F01B 31/00

[52] U.S. Cl. ..... 417/521; 417/568; 417/430; 417/439; 92/86.5

[58] Field of Search ..... 417/26, 254, 258, 430, 417/439, 521, 568; 92/86.5, 87, 103 M, 104, 105

[56] References Cited

U.S. PATENT DOCUMENTS

| | | | |
|---|---|---|---|
| 2,711,137 | 6/1955 | Moller | 92/153 |
| 3,680,985 | 8/1972 | Ginsberg et al. | 417/502 |
| 3,945,768 | 3/1976 | Gueorgi | 417/402 |
| 4,173,437 | 11/1979 | Leka et al. | 417/521 |
| 4,453,898 | 6/1984 | Leka et al. | 417/521 |

FOREIGN PATENT DOCUMENTS

| | | | |
|---|---|---|---|
| 9102158 | 2/1991 | PCT Int'l Appl. | 417/521 |

*Primary Examiner*—Richard A. Bertsch
*Assistant Examiner*—Alfred Basichas
*Attorney, Agent, or Firm*—Douglas B. Farrow

[57] ABSTRACT

A multiple piston cylinder reciprocating pump is provided with a cam drive such that the sum of the velocities during the pumping strokes of all of the cylinders is generally constant. The leak free design is provided by utilizing a diaphragm attached to the piston between the main seal assembly and the cam. A flow through intake design is provided which flows incoming material around the piston between the diaphragm and the main seal to prevent the build-up and hardening of material on the piston and in the seal area. The intake and exhaust passages are arranged such that air pockets cannot be formed and any air bubbles which find their way into the pump will rise upwardly out of the pump without restriction.

16 Claims, 4 Drawing Sheets

PULSELESS PISTON PUMP

RELATED APPLICATION

This application is a continuation in part of Ser. No. 391,097 filed Aug. 8, 1989.

BACKGROUND OF THE INVENTION

A myriad of different types of pumps are known for use in pumping various materials. When it is desired to pump difficult materials, i.e., those that are highly viscous and/or abrasive, the number of choices of pumps suitable for such applications drops substantially, particularly when it is desired to pump such materials at relatively elevated pressures and/or at predetermined flow rates. While reciprocating piston pumps have been widely used in such applications, such pumps suffer from having pulses in the pressure output of the pumps during piston reversal. Such pumps also suffer to a certain extent from leakage and seepage of pumped material past the seals which is particularly critical when the material is air-sensitive such as isocyanates. This leakage is in both directions and can cause environmental contamination, pumped fluid contamination and regenerative abrasive wear damage to the pump. The reduction and/or elimination of pulses in the output is particularly important for circulating systems, fine spray applications and proportional metering to produce constant output.

Centrifugal pumps are capable of pumping abrasive materials without pressure pulses but suffer from the problems of not being positive displacement type (flow rate is not directly related to speed), inefficiency, shaft seal leakage and impose a high degree of shear on materials which may be shear-sensitive.

Gear pumps are commonly used for metering and proportioning apparatus due their ease in synchronizing with other pumps. Such products, however, are ill-suited for pumping of abrasive materials which cause unacceptable wear.

It is therefore an object of this invention to provide a pump capable of handling such materials while providing substantially pulseless operation. It is further an object of this invention to provide such a pump which is easily manufactured and which is capable of being operated at varying speeds, flow rates and pressures in an efficient manner. It is yet a further object of this invention to provide such a pump which has leak-proof operation to avoid contamination of the environment in which the pump is located or contamination of the pumped fluid by the environment.

SUMMARY OF THE INVENTION

A multi-piston/cylinder pump is driven by a cam. The use of pistons in conjunction with diaphragms allows a much higher pressure output capability that a simple diaphragm pump and a more positive displacement action than diaphragm pumps. The cam is powered by a DC motor or other type of conventional variable speed rotary driving mechanism (electric, hydraulic or the like). When used with these drives, the pump can be stalled against pressure just like a typical air-operated reciprocating piston pump. This mode allows adjustable constant flow.

A constant speed motor driving the pump would use a pressure switch to turn the motor on and off. Because the motion input to the pump is rotary, it can be easily synchronized with another pump(s) to provide a plural component material proportioning system or with a conveyor to more fully automate production. The pulseless aspect of the instant invention is particularly important in metering and dispensing operations.

The cam profile is designed so that the reciprocating pistons (which alternate between pumping and intake strokes) have a net velocity sum of their pumping strokes which is generally constant. By doing so, one essentially can eliminate pressure losses that create pulses which result from the piston reversal of a conventional piston pump. In the preferred embodiment, two pistons are used although it can be appreciated that more pistons may be used if desired.

As shown in this application, intake flow is controlled by check valves which typically take a discreet amount of time to seat. Fluid can flow backwards during this time causing small pump output pressure variations during the valve seating but such can be compensated for by shaping the cam profile to provide a nearly totally pulseless operation. Similarly, fluid compressibility can be compensated for via the same method.

Each piston is sealed in its respective cylinder by a relatively conventional type seal mechanism. Attached to the piston on the low pressure intake side of the seal is a diaphragm which serves to isolate the fluid from the environment and assure a leak proof device. As used in this application, the term "diaphragm" is understood to include membranes, bellows or other such structures performing a similar function. An intake passage provides flow directly over the piston between the main seal and the diaphragm to prevent the build-up and hardening of material in the intake section and on the piston. The intake flow then passes through the intake check and into the pumping chamber and then exits through an outlet passage which also has a check valve. This flow path minimizes stagnant areas of non-flowing fluid where fluids may settle out and/or harden. The passage is oriented to minimize air entrapment and continually replenish the fluid in the intake area.

The cam can either be of a push-pull type, that is, where the roller rides in a track or can be a conventional outer profile cam wherein the piston assembly roller is spring loaded against the cam to maintain it in position.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

Figure 3A:
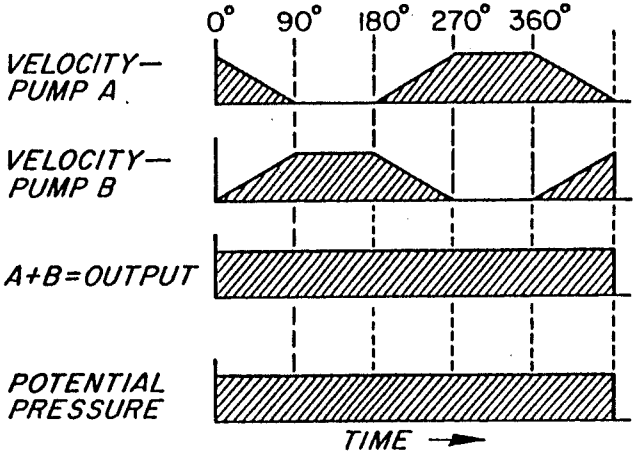
FIG. 3 is an alternate embodiment of the cam of FIG. 2.
Figure 2:
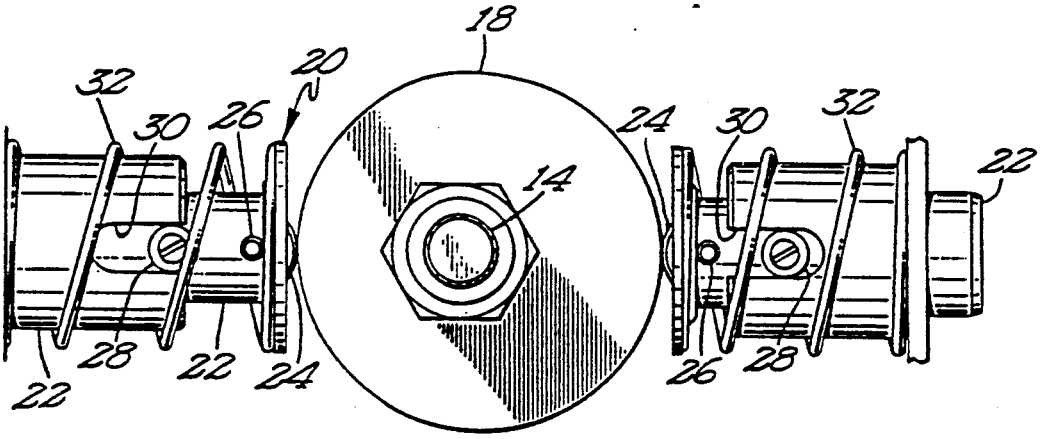
FIG. 2 is a cross section taken along 2—2 of FIG. 1 showing the cam of the instant invention.

FIG. 3*a* is a chart showing the velocities and outputs of a two piston pump.

Figure 4:
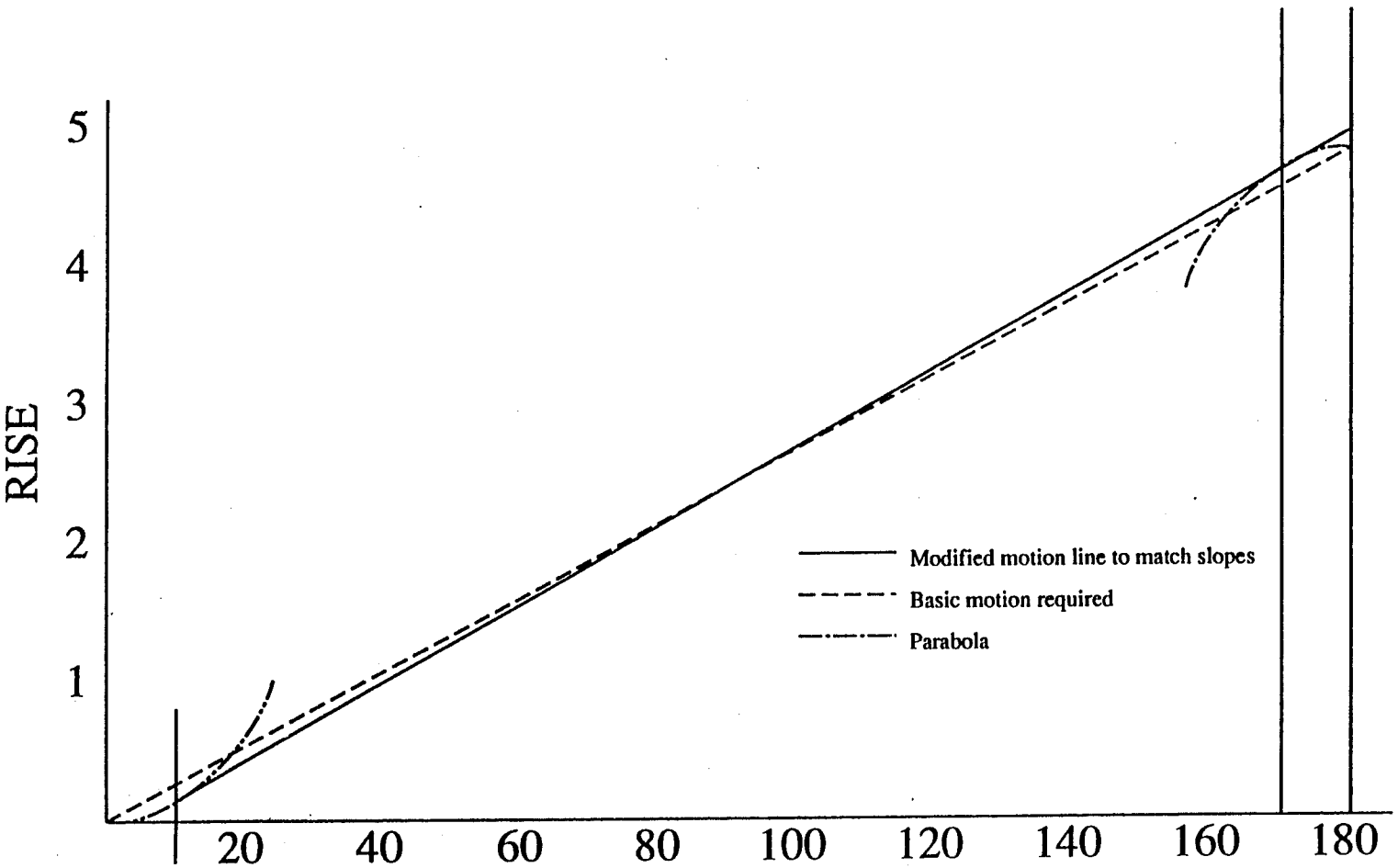

FIG. 4 is a chart showing how to lay out desired cam motion.

Figure 5:
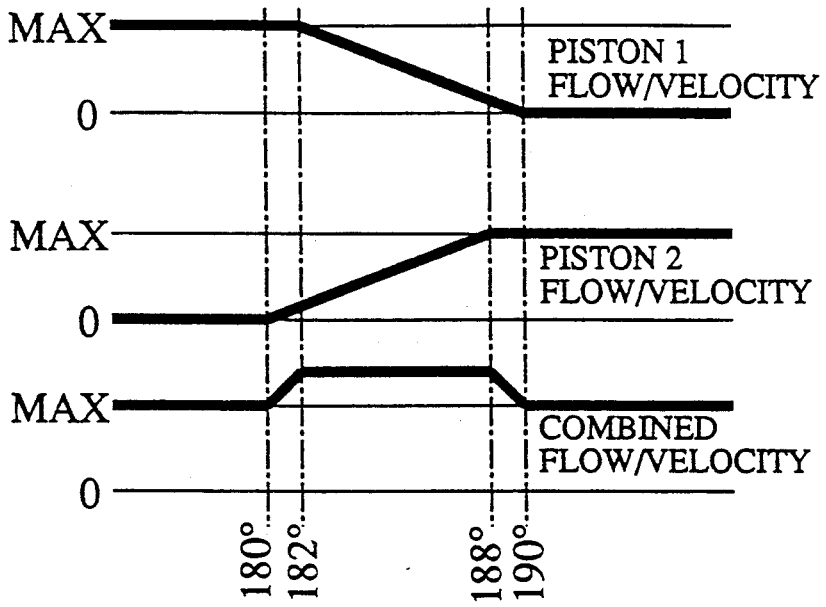

FIG. 5 shows the velocities and outputs of a two-piston pump operating at relatively low pressure and high volume.

Figure 6:
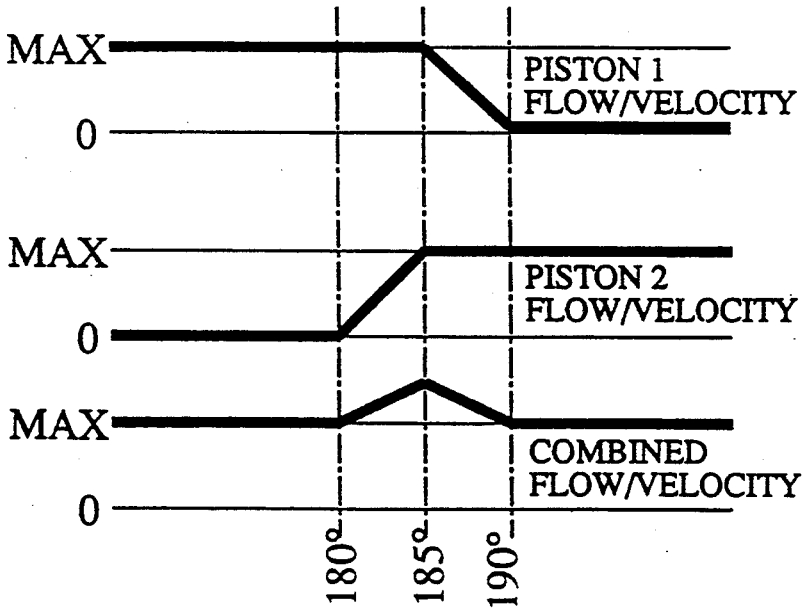

FIG. 6 is a chart showing the velocities and outputs with a two-piston pump operating at high pressures.

DESCRIPTION OF THE PREFERRED EMBODIMENT

The pump of the instant invention, generally designated 10, is comprised of a main housing 12 in which runs a shaft 14 having a gear 16 mounted thereon. A motor (not shown) which may be a DC brushless type motor, drives gear 16 and shaft 14 to turn cam 18 mounted on the end thereof. A cam follower assembly 20 rides on cam 18 and is comprised of a follower housing 22 having a follower 24 mounted thereto via shaft 26. Follower housing 22 has guide rollers 28 mounted on the outside thereof which run in slots 30 in housing 12. Follower assembly 20 is spring loaded against cam 18 by means of a spring 32.

Follower assembly 20 is attached to a piston 34 and located in between follower 22 and piston 34 is a diaphragm 36. Those three parts are fastened together by a bolt 38 which passes consecutively therethrough. An initial inlet passage 40 leads into a flushing chamber 42 located about piston 34 between diaphragm 36 and main pressure seal 44 in cylinder 46. Flushing chamber 42 runs circumferentially around piston 34 thus inlet flow therethrough serves to flush material through which might potentially harden off the surface of piston 34. Inlet flow thence passes through passage 48 in to main inlet passage 50 which has located in series therein a check valve 52 of a conventional nature.

Figure 1:
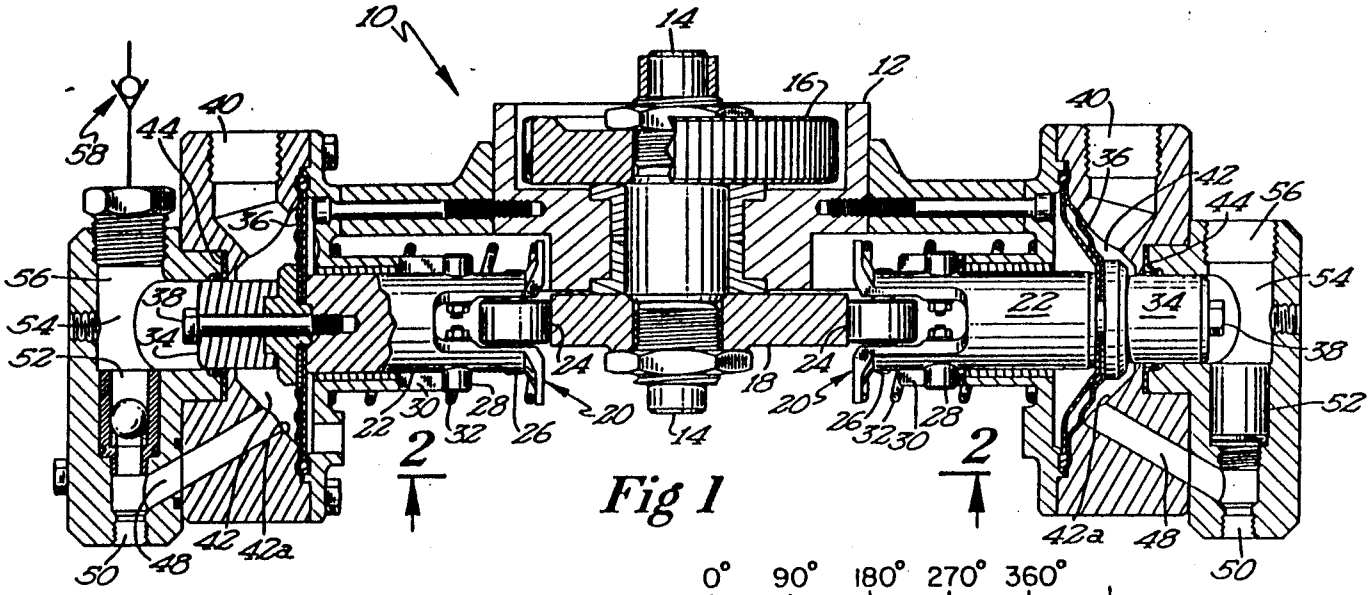
FIG. 1 is a general cross section of the pump of the instant invention.

Pumping chamber 54 is located in the end of cylinder 46 over piston 34 and also has connected thereto outlet passage 56 having an outlet check 58 of conventional design therein. When the device is positioned as oriented in FIG. 1, that is with the inlet and outlet ports 40 and 56 respectively facing upwardly, the product is designed so as to prevent the accumulation of air or other gas within pockets of the pump, that is, all such bubbles and gas may freely flow upwardly and out of the pump thereby reducing problems of priming and assuring full volumetric flow without air entrapment. It can be seen as piston 34 moves upwardly into pumping chamber 54, diaphragm 36 flexes upwardly to the point of nearly touching the upper surface 42*a* of flushing chamber 42 thereby continually assuring a fresh flow of material through the pump and the prevention of stagnant flow zones therein.

Figure 3:
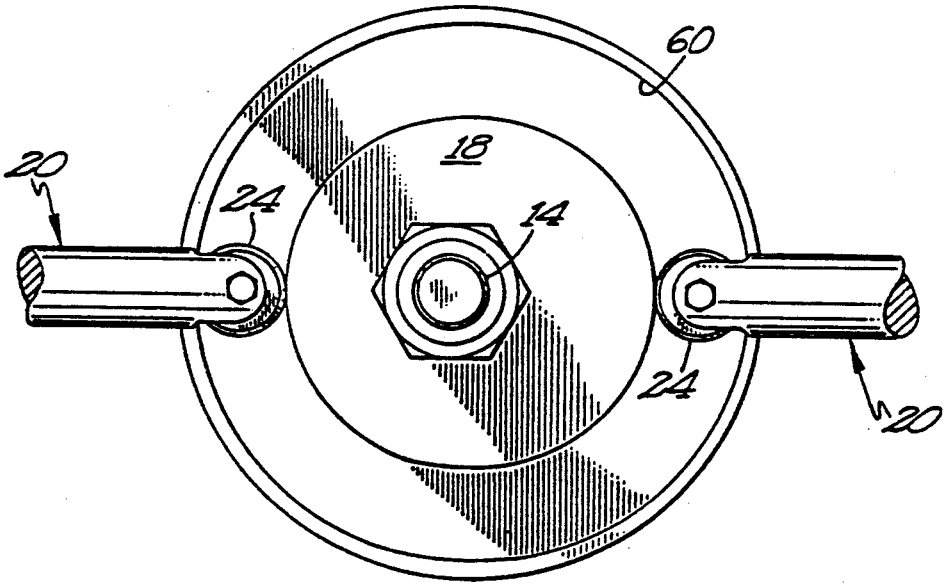

While the embodiment shown in the drawing figures utilizes a spring loaded follower and cam, it can also be appreciated that the cam drive may be of a different type wherein no such spring is necessary. Such a type of cam is often referred to as a desmodromic type cam, and an example of such a cam is shown in FIG. 3 wherein the roller is guided in a track 60 and is driven in both its pumping and intake strokes. It can also be appreciated that seal 44 may be of any conventional type which is capable of performing a proper sealing function, however, it can be appreciated that because diaphragm 36 is subjected to relatively low pressures, its service life will be dramatically increased to maintain the pump in a substantially leak-free state. It can also be seen that if seal 44 should leak, its leakage is from the high pressure side back into the inlet rather than into the environment.

Up to this point, the description has been of a theoretically perfect pump. In reality, check valve physics (closing time, etc.), fluid compressibility and viscosity preclude perfect pulseless output. Satisfactory pulseless output may be obtained by modifying the cam profile to compensate for the above factors. By increasing the velocity of the opposite piston during check valve closing time by putting a "blip" in the cam to change the velocity profile, the pumping action can be slightly increased near the point of check valve seating to compensate for the decreased output during the seating time. The required net velocity profile for pulseless output may be different for any material which is pumped. Using a representative fluid such as oil for the purposes of optimizing the velocity profile of the pump results in a solution which is satisfactory for most other fluids.

The following shows the basic mechanism for laying out the desired curve to compensate for various nonlinearities in a real life pumping system. In particular, at elevated pressures, the compressability of the fluid must be compensated for and in order to do so an overlap of the parabolic rise and falls of successive cycles is imposed as shown in FIG. 6. Similarly, at lower pressures, the compressability aspect of the fluid is negligible and therefore it is only required to compensate for the closing of the check valves and towards that end a system more like that shown in FIG. 5 is appropriate.

Formulas

Parabola: $d=k\Theta_P^2$; $s=2k\Theta_P$

Sine: $d=\sin\Theta d_{req}$; $s=1/\tan\Theta$

Circle: $d=\sqrt{r^2-x^2}$

Line: $d=s\Theta L$; to match parabola, s must also be $2k\Theta_P$ then $d=(2k\Theta_P)(\Theta_L)$

Step 1

Lay out basic motion line

Step 2

Modify basic motion line to smooth transitions and limit jerk.

Step 3

Find smallest motion segment i.e. 10° for parabola; $\Theta_P=10°$

Step 4

Determine total rise segment $D_1=d_{0°-10°}+d_{10°-170°}+d_{170°-180°}$ $D_1=1k\Theta_P^2+(2k\Theta_P)(\Theta_L)+1k\Theta_P$

Step 5

Find coefficient k $$k=\frac{D_1}{(\Theta_{TOTAL}^2-\Theta_{LIN}^2)/\text{SEGMENTS OF }\Theta_P\text{ EQUAL}}$$

$$k=\frac{D_1}{(180^2-160^2)/2}$$

ie $$k=\frac{.5}{(180^2-160^2)/2}$$

$k=0.00147059$

Then do the same for the return stroke in the example shown:

$d_{10}=k\Theta_S^2=0.147059$ $d_{170}=d_{10}+2*k*\Theta_P*\Theta_L)$ $$0.147059+4.70588=4.85294$$

$$d_{180}=d_{170}+d_{10}$$

$$4.85294+0.147059=5.00$$

Below is a table showing cam lifts in relation to rotational position suitable for use with a low pressure pump yielding results of the FIG. 5 curve:

| Rotational Position (Degrees) | Lift |
|---|---|
| 0.00 | 0.617 |
| 2.00 | 0.616 |
| 4.00 | 0.613 |
| 6.00 | 0.609 |
| 8.00 | 0.603 |
| 10.00 | 0.596 |
| 12.00 | 0.589 |
| 14.00 | 0.582 |
| 16.00 | 0.576 |
| 18.00 | 0.569 |
| 20.00 | 0.562 |
| 22.00 | 0.555 |
| 24.00 | 0.549 |
| 26.00 | 0.542 |
| 28.00 | 0.535 |
| 30.00 | 0.528 |
| 32.00 | 0.521 |
| 34.00 | 0.515 |
| 36.00 | 0.508 |
| 38.00 | 0.501 |
| 40.00 | 0.494 |
| 42.00 | 0.488 |
| 44.00 | 0.481 |
| 46.00 | 0.474 |
| 48.00 | 0.467 |
| 50.00 | 0.460 |
| 52.00 | 0.454 |
| 54.00 | 0.447 |
| 56.00 | 0.440 |
| 58.00 | 0.433 |
| 60.00 | 0.427 |
| 62.00 | 0.420 |
| 64.00 | 0.413 |
| 66.00 | 0.406 |
| 68.00 | 0.399 |
| 70.00 | 0.393 |
| 72.00 | 0.386 |
| 74.00 | 0.379 |
| 76.00 | 0.372 |
| 78.00 | 0.366 |
| 80.00 | 0.359 |
| 82.00 | 0.352 |
| 84.00 | 0.345 |
| 86.00 | 0.338 |
| 88.00 | 0.332 |
| 90.00 | 0.325 |
| 92.00 | 0.318 |
| 94.00 | 0.311 |
| 96.00 | 0.305 |
| 98.00 | 0.298 |
| 100.00 | 0.291 |
| 102.00 | 0.284 |
| 104.00 | 0.277 |
| 106.00 | 0.271 |
| 108.00 | 0.264 |
| 110.00 | 0.257 |
| 112.00 | 0.250 |
| 114.00 | 0.244 |
| 116.00 | 0.237 |
| 118.00 | 0.230 |
| 120.00 | 0.223 |
| 122.00 | 0.216 |
| 124.00 | 0.210 |
| 126.00 | 0.203 |
| 128.00 | 0.196 |
| 130.00 | 0.189 |
| 132.00 | 0.183 |
| 134.00 | 0.176 |
| 136.00 | 0.169 |
| 138.00 | 0.162 |

-continued

| Rotational Position (Degrees) | Lift |
|---|---|
| 140.00 | 0.156 |
| 142.00 | 0.149 |
| 144.00 | 0.142 |
| 146.00 | 0.135 |
| 148.00 | 0.128 |
| 150.00 | 0.122 |
| 152.00 | 0.115 |
| 154.00 | 0.108 |
| 156.00 | 0.101 |
| 158.00 | 0.095 |
| 160.00 | 0.088 |
| 162.00 | 0.081 |
| 164.00 | 0.074 |
| 166.00 | 0.067 |
| 168.00 | 0.061 |
| 170.00 | 0.054 |
| 172.00 | 0.047 |
| 174.00 | 0.040 |
| 176.00 | 0.034 |
| 178.00 | 0.027 |
| 180.00 | 0.020 |
| 182.00 | 0.013 |
| 184.00 | 0.007 |
| 186.00 | 0.003 |
| 188.00 | 0.001 |
| 190.00 | 0.000 |
| 192.00 | 0.000 |
| 194.00 | 0.001 |
| 196.00 | 0.003 |
| 198.00 | 0.005 |
| 200.00 | 0.007 |
| 202.00 | 0.011 |
| 204.00 | 0.015 |
| 206.00 | 0.019 |
| 208.00 | 0.024 |
| 210.00 | 0.030 |
| 212.00 | 0.036 |
| 214.00 | 0.043 |
| 216.00 | 0.050 |
| 218.00 | 0.058 |
| 220.00 | 0.067 |
| 222.00 | 0.075 |
| 224.00 | 0.084 |
| 226.00 | 0.093 |
| 228.00 | 0.102 |
| 230.00 | 0.111 |
| 232.00 | 0.119 |
| 234.00 | 0.128 |
| 236.00 | 0.137 |
| 238.00 | 0.146 |
| 240.00 | 0.155 |
| 242.00 | 0.163 |
| 244.00 | 0.172 |
| 246.00 | 0.181 |
| 248.00 | 0.190 |
| 250.00 | 0.199 |
| 252.00 | 0.207 |
| 254.00 | 0.216 |
| 256.00 | 0.225 |
| 258.00 | 0.234 |
| 260.00 | 0.243 |
| 262.00 | 0.251 |
| 264.00 | 0.260 |
| 266.00 | 0.269 |
| 268.00 | 0.278 |
| 270.00 | 0.287 |
| 272.00 | 0.296 |
| 274.00 | 0.304 |
| 276.00 | 0.313 |
| 278.00 | 0.322 |
| 280.00 | 0.331 |
| 282.00 | 0.430 |
| 284.00 | 0.348 |
| 286.00 | 0.375 |
| 288.00 | 0.366 |
| 290.00 | 0.375 |
| 292.00 | 0.384 |
| 294.00 | 0.392 |
| 296.00 | 0.401 |
| 298.00 | 0.410 |
| 300.00 | 0.419 |

-continued

| Rotational Position (Degrees) | Lift |
|---|---|
| 302.00 | 0.428 |
| 304.00 | 0.436 |
| 306.00 | 0.445 |
| 308.00 | 0.454 |
| 310.00 | 0.463 |
| 312.00 | 0.472 |
| 314.00 | 0.481 |
| 316.00 | 0.489 |
| 318.00 | 0.498 |
| 320.00 | 0.507 |
| 322.00 | 0.516 |
| 324.00 | 0.525 |
| 326.00 | 0.533 |
| 328.00 | 0.532 |
| 330.00 | 0.551 |
| 332.00 | 0.559 |
| 334.00 | 0.567 |
| 336.00 | 0.575 |
| 338.00 | 0.581 |
| 340.00 | 0.588 |
| 342.00 | 0.593 |
| 344.00 | 0.598 |
| 346.00 | 0.602 |
| 348.00 | 0.606 |
| 350.00 | 0.609 |
| 352.00 | 0.612 |
| 354.00 | 0.614 |
| 356.00 | 0.615 |
| 358.00 | 0.616 |
| 360.00 | 0.617 |

As can be seen, this curve has a 190 degree rise and 8 degree blends. This provides a relatively small overlap because no compressability compensation needs to be made.

Similarly, for a high pressure system such as that shown in FIG. 6, the following table shows the cam layout which is provided with 190 degree rise and 5 degree blends. This embodiment has a large overlap to compensate for the changeover losses due to compressability.

| Rotational Position (Degrees) | Lift |
|---|---|
| 0.00 | 0.617 |
| 2.00 | 0.615 |
| 4.00 | 0.611 |
| 6.00 | 0.605 |
| 8.00 | 0.598 |
| 10.00 | 0.591 |
| 12.00 | 0.585 |
| 14.00 | 0.578 |
| 16.00 | 0.571 |
| 18.00 | 0.565 |
| 20.00 | 0.558 |
| 22.00 | 0.551 |
| 24.00 | 0.545 |
| 26.00 | 0.538 |
| 28.00 | 0.531 |
| 30.00 | 0.525 |
| 32.00 | 0.518 |
| 34.00 | 0.511 |
| 36.00 | 0.505 |
| 38.00 | 0.498 |
| 40.00 | 0.491 |
| 42.00 | 0.485 |
| 44.00 | 0.478 |
| 46.00 | 0.471 |
| 48.00 | 0.465 |
| 50.00 | 0.458 |
| 52.00 | 0.451 |
| 54.00 | 0.445 |
| 56.00 | 0.438 |
| 58.00 | 0.431 |
| 60.00 | 0.425 |
| 62.00 | 0.418 |
| 64.00 | 0.411 |

-continued

| Rotational Position (Degrees) | Lift |
|---|---|
| 66.00 | 0.405 |
| 68.00 | 0.398 |
| 70.00 | 0.391 |
| 72.00 | 0.385 |
| 74.00 | 0.378 |
| 76.00 | 0.371 |
| 78.00 | 0.365 |
| 80.00 | 0.358 |
| 82.00 | 0.351 |
| 84.00 | 0.345 |
| 86.00 | 0.338 |
| 88.00 | 0.331 |
| 90.00 | 0.325 |
| 92.00 | 0.318 |
| 94.00 | 0.311 |
| 96.00 | 0.305 |
| 98.00 | 0.298 |
| 100.00 | 0.291 |
| 102.00 | 0.285 |
| 104.00 | 0.278 |
| 106.00 | 0.271 |
| 108.00 | 0.265 |
| 110.00 | 0.258 |
| 112.00 | 0.251 |
| 114.00 | 0.245 |
| 116.00 | 0.238 |
| 118.00 | 0.231 |
| 120.00 | 0.225 |
| 122.00 | 0.218 |
| 124.00 | 0.211 |
| 126.00 | 0.205 |
| 128.00 | 0.198 |
| 130.00 | 0.191 |
| 132.00 | 0.185 |
| 134.00 | 0.178 |
| 136.00 | 0.171 |
| 138.00 | 0.165 |
| 140.00 | 0.158 |
| 142.00 | 0.151 |
| 144.00 | 0.145 |
| 146.00 | 0.138 |
| 148.00 | 0.131 |
| 150.00 | 0.125 |
| 152.00 | 0.118 |
| 154.00 | 0.111 |
| 156.00 | 0.105 |
| 158.00 | 0.098 |
| 160.00 | 0.091 |
| 162.00 | 0.085 |
| 164.00 | 0.078 |
| 166.00 | 0.071 |
| 168.00 | 0.065 |
| 170.00 | 0.058 |
| 172.00 | 0.051 |
| 174.00 | 0.045 |
| 176.00 | 0.038 |
| 178.00 | 0.031 |
| 180.00 | 0.025 |
| 182.00 | 0.018 |
| 184.00 | 0.011 |
| 186.00 | 0.005 |
| 188.00 | 0.001 |
| 190.00 | 0.000 |
| 192.00 | 0.000 |
| 194.00 | 0.001 |
| 196.00 | 0.003 |
| 198.00 | 0.005 |
| 200.00 | 0.007 |
| 202.00 | 0.011 |
| 204.00 | 0.015 |
| 206.00 | 0.019 |
| 208.00 | 0.024 |
| 210.00 | 0.030 |
| 212.00 | 0.036 |
| 214.00 | 0.043 |
| 216.00 | 0.050 |
| 218.00 | 0.058 |
| 220.00 | 0.067 |
| 222.00 | 0.075 |
| 224.00 | 0.084 |
| 226.00 | 0.093 |

-continued

| Rotational Position (Degrees) | Lift |
|---|---|
| 228.00 | 0.102 |
| 230.00 | 0.111 |
| 232.00 | 0.119 |
| 234.00 | 0.128 |
| 236.00 | 0.137 |
| 238.00 | 0.146 |
| 240.00 | 0.155 |
| 242.00 | 0.163 |
| 244.00 | 0.172 |
| 246.00 | 0.181 |
| 248.00 | 0.190 |
| 250.00 | 0.199 |
| 252.00 | 0.207 |
| 254.00 | 0.216 |
| 256.00 | 0.225 |
| 258.00 | 0.234 |
| 260.00 | 0.243 |
| 262.00 | 0.251 |
| 264.00 | 0.260 |
| 266.00 | 0.269 |
| 268.00 | 0.278 |
| 270.00 | 0.287 |
| 272.00 | 0.296 |
| 274.00 | 0.304 |
| 276.00 | 0.313 |
| 278.00 | 0.322 |
| 280.00 | 0.331 |
| 282.00 | 0.340 |
| 284.00 | 0.348 |
| 286.00 | 0.357 |
| 288.00 | 0.366 |
| 290.00 | 0.375 |
| 292.00 | 0.384 |
| 294.00 | 0.392 |
| 296.00 | 0.401 |
| 298.00 | 0.410 |
| 300.00 | 0.419 |
| 302.00 | 0.428 |
| 304.00 | 0.436 |
| 306.00 | 0.445 |
| 308.00 | 0.454 |
| 310.00 | 0.463 |
| 312.00 | 0.472 |
| 314.00 | 0.481 |
| 316.00 | 0.489 |
| 318.00 | 0.498 |
| 320.00 | 0.507 |
| 322.00 | 0.516 |
| 324.00 | 0.525 |
| 326.00 | 0.533 |
| 328.00 | 0.542 |
| 330.00 | 0.551 |
| 332.00 | 0.559 |
| 334.00 | 0.567 |
| 336.00 | 0.575 |
| 338.00 | 0.581 |
| 340.00 | 0.588 |
| 342.00 | 0.593 |
| 344.00 | 0.598 |
| 346.00 | 0.602 |
| 348.00 | 0.606 |
| 350.00 | 0.609 |
| 352.00 | 0.612 |
| 354.00 | 0.614 |
| 356.00 | 0.615 |
| 358.00 | 0.616 |
| 360.00 | 0.617 |

Additionally, it can be appreciated that such a pump is easily adaptable to power operated valving, that is, valving which could be operated electrically and/or through a mechanical linkage not unlike an automotive engine such that the valve opening and closing time can be selected as desired.

It is contemplated that various changes and modifications may be made to the pump without departing from the spirit and scope of the invention as defined by the following claims.

What is claimed is:

1. A fluid pump for providing substantially pulseless output comprising;

a plurality of piston-cylinder combinations;

cam means for driving each said piston in each said cylinder, said cam means driving each said piston in each said cylinder in a reciprocating motion alternating between intake strokes and pumping strokes, said intake strokes and said pumping strokes being divided by a changeover point, said cam means driving said pistons such that at least one said piston is in said pumping stroke at all times and the sum of the velocities of said pistons in said pumping strokes is substantially constant at any given speed of said cam means;

a housing;

a high-pressure seal between said piston and said cylinder for sealing material to be pumped, said piston remaining in contact with said seal at all times;

a sealing diaphragm attached to said housing and said piston intermediate said high pressure seal and said cam means and forming a chamber therebetween and constructed to contain any material that might leak past said high pressure seal and as a barrier between the material to be pumped and the environment, said chamber being sealed from the environment; and inlet check valves, said cam means increasing said velocity sum relative to said constant prior to said changeover point to create a compensating motion overlap so as to compensate for the nonlinearity of pump output during seating of said check valves.

2. The pump of claim 1 further comprising a flushing inlet passage leading from a source of material to be pumped around said piston intermediate said diaphragm and said high pressure seal to minimize stagnation and prevent buildup or solidification of pumped material on said piston.

3. The pump of claim 2 wherein said cylinder, said piston and said high pressure seal form a pumping chamber and said pump further comprises a main inlet passage connecting said flushing inlet passage and said pumping chamber.

4. The pump of claim 3 wherein said main inlet passage comprises an inlet check valve.

5. The pump of claim 4 wherein said inlet passage is located so as to run in a generally vertical direction and configured so as to prevent the trapping of gasses in said chamber and in said passage whereby any gasses will rise through said passage out of said pump.

6. The pump of claim 4 further comprising an outlet passage leading from said pumping chamber, said inlet and outlet passages being located so as to run in a generally vertical direction and configured so as to prevent the trapping of gasses in said chamber and said passages whereby any gasses will rise through said passages out of said pump.k 7. The pump of claim 1 wherein said cam means is driven by a variable speed motor.

8. The pump of claim 1 further comprising power operated valving.

9. A fluid pump for providing substantially pulseless output comprising;

a plurality of piston-cylinder combinations;

cam means for driving each said piston in each said cylinder, said cam means driving each said piston in each said cylinder in a reciprocating motion alternating between intake strokes and pumping strokes, said cam means driving said pistons such that at least one said piston is in said pumping stroke at all times and the sum of the velocities of said pistons in said pumping strokes is substantially constant at any given speed of said cam means;

a housing;

a high-pressure seal between said piston and said cylinder for sealing material to be pumped, said piston remaining in contact with said seal at all times; and a sealing diaphragm attached to said housing and said piston intermediate said high pressure seal and said cam means and to contain any material that might leak past said high pressure seal and as a barrier between the material to be pumped and the environment a flushing inlet passage leading from a source of material to be pumped around said piston intermediate said diaphragm and said high pressure seal to minimize stagnation and prevent buildup or solidification of pumped material on said piston wherein said cylinder, said piston and said high pressure seal form a pumping chamber and said pump further comprises a main inlet passage connecting said flushing inlet passage and said pumping chamber.

10. The pump of claim 9 wherein said inlet passage is located so as to run in a generally vertical direction and configured so as to prevent the trapping of gasses in said chamber and in said passage whereby any gasses will rise through said passage out of said pump.

11. The pump of claim 10 further comprising an outlet passage leading from said pumping chamber, said inlet and outlet passages being located so as to run in a generally vertical direction and configured so as to prevent the trapping of gasses in said chamber and said passages whereby any gasses will rise through said passages out of said pump.

12. The pump of claim 9 wherein said cam means is driven by a variable speed motor.

13. The pump of claim 9 further comprising power operated valving.

14. The pump of claim 1 wherein said cam means compensates for the seating characteristics of said check valves.

15. The pump of claim 1 wherein said cam means compensates for the compressibility of the material being pumped.

16. The pump of claim 1 wherein said cam means comprises parabolic rise and fall zones during said overlap.

* * * * *